US008087274B2

(12) United States Patent
Yu et al.

(10) Patent No.: US 8,087,274 B2
(45) Date of Patent: Jan. 3, 2012

(54) LOCK STRUCTURE WITH AUTO-RESET FUNCTION

(75) Inventors: Chang-Chiang Yu, Taipei County (TW); Chun-Sheng Wu, Taipei County (TW)

(73) Assignee: Sinoxlock (Kunshan) Co., Ltd, Kunshan (CN)

( * ) Notice: Subject to any disclaimer, the term of this patent is extended or adjusted under 35 U.S.C. 154(b) by 24 days.

(21) Appl. No.: 12/759,668

(22) Filed: Apr. 13, 2010

(65) Prior Publication Data

US 2010/0257907 A1 Oct. 14, 2010

Related U.S. Application Data

(60) Provisional application No. 61/168,933, filed on Apr. 14, 2009.

(30) Foreign Application Priority Data

Sep. 4, 2009 (CN) ..... 2009 1 0171098

(51) Int. Cl.
*E05B 37/00* (2006.01)

(52) U.S. Cl. ..... 70/284; 70/285; 70/312; 70/314; 70/315; 70/318

(58) Field of Classification Search ..... 70/284, 70/285, 312, 314, 315, 318
See application file for complete search history.

(56) References Cited

U.S. PATENT DOCUMENTS

| | | | | | |
|---|---|---|---|---|---|
| 4,444,029 | A * | 4/1984 | Remington | ..... | 70/312 |
| 4,679,419 | A * | 7/1987 | Scelba | ..... | 70/312 |
| 4,770,013 | A * | 9/1988 | Nakai | ..... | 70/285 |
| 4,885,923 | A * | 12/1989 | Nakai | ..... | 70/284 |
| 4,899,559 | A * | 2/1990 | Chern | ..... | 70/312 |
| 5,007,262 | A * | 4/1991 | Nakai | ..... | 70/312 |
| 5,345,798 | A | 9/1994 | Nakai | | |
| 6,026,665 | A * | 2/2000 | Raybary | ..... | 70/214 |
| 7,434,430 | B2 * | 10/2008 | Huang | ..... | 70/312 |

* cited by examiner

*Primary Examiner* — Lloyd Gall
*Assistant Examiner* — David E Sosnowski

(57) ABSTRACT

A lock structure including an activation device, a combination lock, and a setting device is provided. The combination lock has a plurality of dials, a shaft passing through the dials, and a plurality of first gears disposed on one side of each dial. Each first gear further includes a missing tooth. One end of the shaft is connected to the activation device. The setting device has a plurality of second gears corresponding to the first gears and a setting shaft, wherein one end of the setting shaft passes through the second gears and the other end is connected to the activation device. When the activation device is activated, the second gears are driven to rotate the first gears, so that when each second gear runs free with the missing tooth of each first gear, the dials are in a predetermined position. That is, by means of the activation device and the setting device, the dials of the combination lock can automatically return to the predetermined position after opening or closing the lock.

18 Claims, 13 Drawing Sheets

LOCK STRUCTURE WITH AUTO-RESET FUNCTION

This application claims priority based on a U.S. provisional patent application No. 61/168,933 filed on Apr. 14, 2009.

BACKGROUND OF THE INVENTION

1. Field of the Invention

The present invention relates to an auto reset device. More particularly, the present invention relates to a dial combination lock structure with auto-reset function wherein the dials can automatically return to a predetermined position after opening or closing the lock.

2. Description of the Prior Art

With the advancement of technology, a variety of locks are developed. Locks are specifically developed for different applications and purposes, for example, in order to protect articles, displayed or temporarily stored in glass showcases, shop windows, or deposit cabinets in markets, schools or other public places, from being stolen or taken away.

Most of currently available locks for use in the public places are a key lock or a combination lock disposed separately. In the case of using the key lock, it is very inconvenient for the user to keep the key in a proper place. Moreover, there is always a risk of losing the key. Therefore, the combination lock is more often used in the public places, such as markets, supermarkets, stores, public baths, dining halls, campuses, or other similar public places. When the combination lock is used in a public cabinet, the user only needs to set a password of the combination lock and unlocks the combination lock by turning the dials.

During the operation, when a new password of the combination lock is set by the user after his/her personal stuffs are put into the deposit cabinet, the user has to purposely mess up the dials of the combination lock to prevent the password from being revealed before leaving the deposit cabinet. Otherwise, the personal stuffs would be very possible to be stolen. Therefore, in order to overcome the above problems, improve convenience and safety, and achieve other purposes, a lock structure with auto-reset function is desired.

SUMMARY OF THE INVENTION

It is an object of the present invention to provide a lock structure with auto-reset function eliminating the need of purposely messing up the dials after the password is set.

It is an object of the present invention to provide a lock structure, wherein the dials can automatically turn to a predetermined position after opening or closing the lock.

It is another object of the present invention to provide a lock structure, which can be readily operated to save operation time.

It is another object of the present invention to provide a cabinet lock employed a lock structure having the auto-reset function.

The lock structure includes an activation device, a combination lock, and a setting device. The combination lock has a plurality dials, a shaft passing through the dials, and a plurality of first gears disposed on one side of each dial. Each first gear includes a missing tooth. One end of the shaft is connected to the activation device. The setting device has a plurality of second gears corresponding to the first gears and a setting shaft. One end of the setting shaft passes through the second gears and the other end is connected to the activation device. When the activation device moves to an unlocked position, the second gears are driven to turn the first gears, so that when each second gear runs free with the missing tooth of each first gear, the dials are in a predetermined position and the combination lock is allowed to reset a password. When the activation device moves to a locked position, the second gear is driven to turn the first gear, so that when each second gear runs free with the missing tooth of each first gear, the dials are in the predetermined position.

In a preferred embodiment, the combination lock includes a plurality of protruding portions and bushings. Each protruding portion is arranged side by side on the surface of the shaft. Each bushing is selectively engaged with each protruding portion. Each bushing can move along the shaft to position or release the shaft. Each first gear is preferably integrally formed with each dial, and the diameter of each first gear is preferably smaller than the diameter of each dial. The setting device further includes at least one convex portion, a linking element, and a plurality of spacers. The convex portion is disposed on the surface of the setting shaft. One end of the linking element is connected to the setting shaft and the other end is connected to the activation device. Each spacer equidistantly links each second gear, and an inner wall of the spacer has at least one groove corresponding to the protruding portion. When the linking element drives the setting shaft to rotate, the convex portions of the setting shaft engage with the grooves of the spacers to turn the second gears synchronously. The linking element has a first linking gear, a second linking gear, and a linking shaft. Both of the first and second gears are eccentric with the linking shaft and driven by the first and second linking gears to rotate, respectively. One end of the setting shaft has a toothed bar engaged with the linking gear.

The activation device further includes a knob, a rotatable slider, an activation sleeve, and a sliding sleeve. The knob has a recess portion and is disposed on one side of a positioning device. The rotatable slider is disposed under the knob and has a blocking portion for contacting one end of the shaft of the combination lock. The activation sleeve has a protruding portion and a plurality of first lugs. The protruding portion is disposed corresponding to the recess portion, and the first lugs are disposed at different angles, respectively. The sliding sleeve has a plurality of second lugs and a driving portion. The second lugs are disposed corresponding to the first lugs, and the driving portion is disposed on one side of the sliding sleeve. When the knob turns, the first lugs of the activation sleeve are rotated to move the second lugs vertically, such that the driving portion drives the second gears of the setting device to rotate via the linking element. In other embodiment, however, the activation device may also include a key lock. The key lock has a lock core, a lock core sleeve, and an assembly member. The lock core is disposed inside the lock core sleeve and connects to the assembly member. The lock core sleeve has two opposite notches for engaging with a plurality of lock tongues. When the key lock is unlocked, the lock tongues are released from the notch to allow the assembly member to rotate. When the key lock is locked, the lock tongues engage with the notch to prevent the assembly member from rotating.

The present invention further includes a cabinet lock including the lock structure described above and a rotatable shield rotatably connected to the activation device. When the activation device moves to the unlocked position, the rotatable shield can rotate from a locked position to an unlocked position. On the contrary, when the activation device moves to the locked position, the rotatable shield can rotate from the unlocked position to the locked position.

DETAILED DESCRIPTION OF THE PREFERRED EMBODIMENT

The present invention provides a lock structure that has a simplified operation design to eliminate the need of purposely messing up the dials to prevent the password from being revealed after the password is set. In a preferred embodiment, the lock structure is applied to a cabinet lock. However, in other embodiments, the lock structure may be applied to a glass lock, a showcase lock, a furniture lock, or other proper locks for use in public places. In one embodiment, the lock structure of the present invention preferably includes both a key lock and a combination lock. In an exemplary embodiment, the key of the key lock is preferably kept by the manager or administrator to unlock the public cabinets or lockers in special circumstances. The combination lock is usually provided for special members or users to temporarily store their personal belongings with a self-defined password.

Figure 1A:
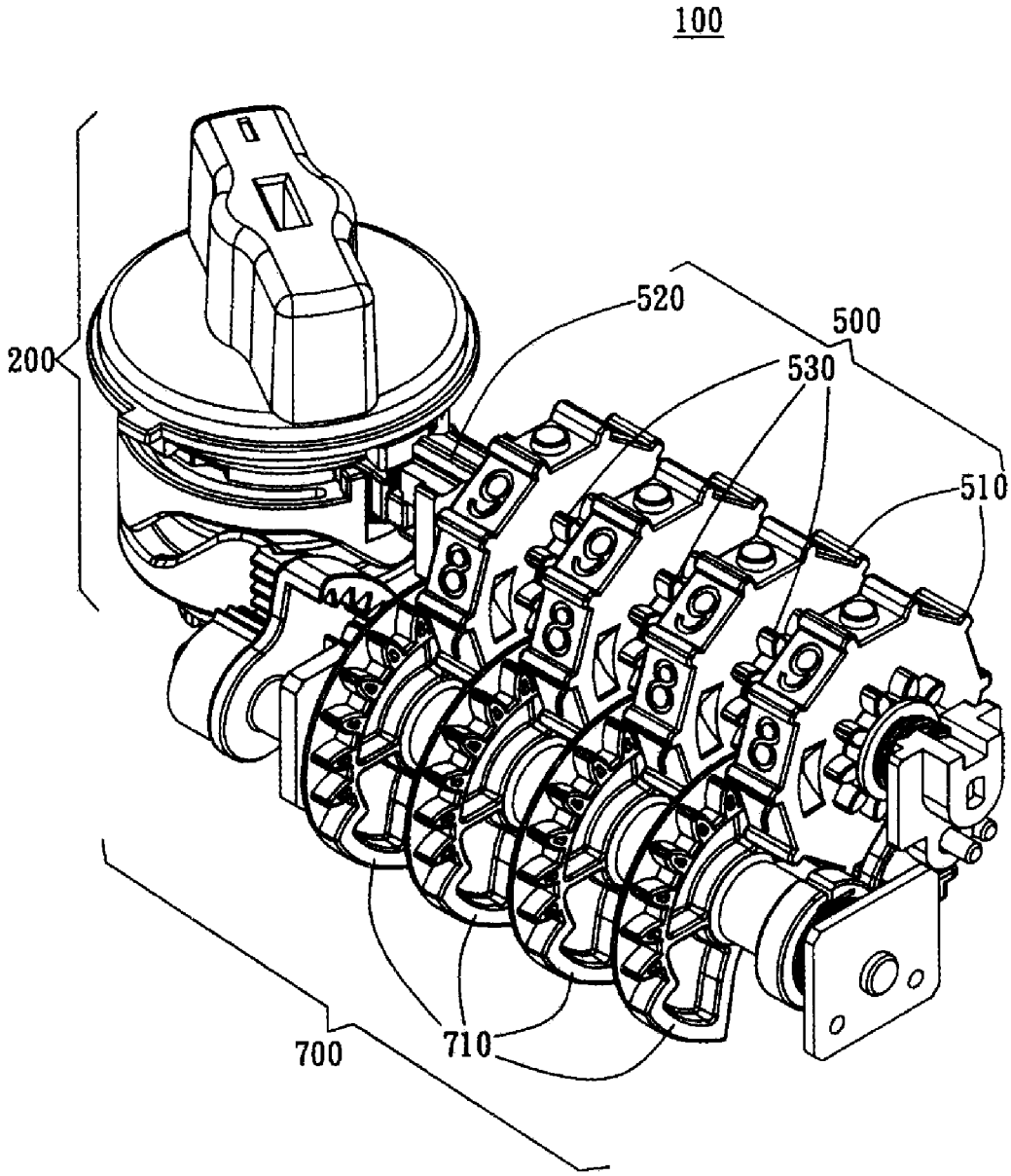
FIG. 1A illustrates a perspective view of a lock structure of the present invention.

As FIG. 1A shows, the lock structure 100 is a dial combination lock structure and includes an activation device 200, a combination lock 500, and a setting device 700. In an embodiment shown in FIG. 1B, however, the lock structure 100 may also include a positioning device 110, a housing 120, and a cover 150. The positioning device 110 is provided for positioning both the combination lock 500 and the setting device 700. The housing 120 has an accommodation space 130 for accommodating elements of the lock structure 100. The cover 150 is formed with a plurality of holes 160 and an opening 170. Each hole 160 corresponds to each dial 510 of the combination lock 500, such that the dials 510 may partially protrude from the holes 160 to be operated by the user. The opening 170 corresponds to a knob 210 of the activation device 200 to allow the knob 210 protrudes from the opening 170 to be operated by the user. The cover 150 covers the accommodation space 130 of the housing 120 while the combination lock 500, the activation device 200, and the setting device 700 are disposed inside the accommodation space 130. Thus, the combination lock 500, the activation device 200, and the setting device 700 may be properly positioned with respect to the positioning device 110.

Figure 2A:
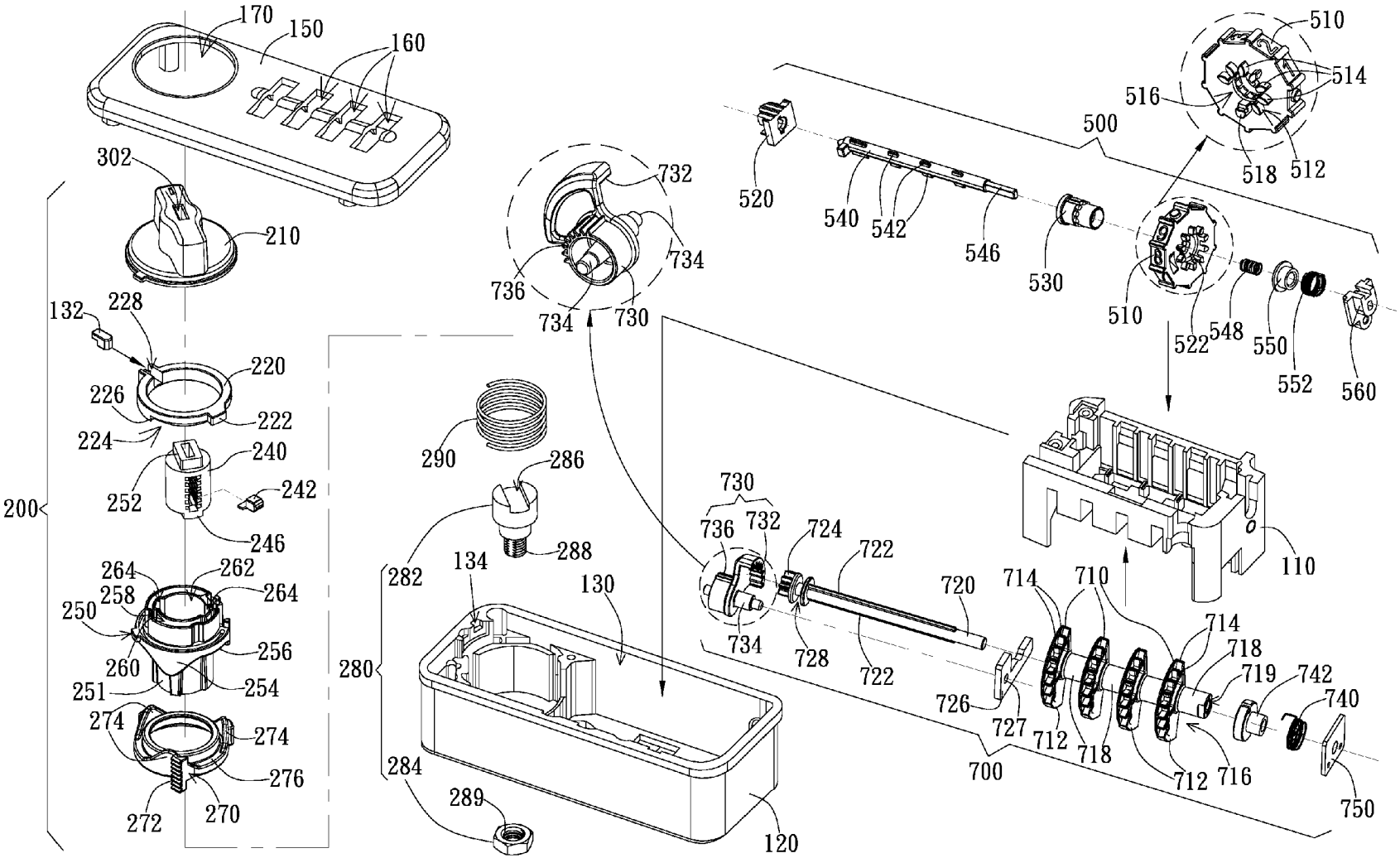
FIG. 2A illustrates an exploded view of the lock structure of the present invention.

As FIG. 2A shows, the combination lock 500 of the lock structure 100 has a plurality of dials 510 (only one of them being illustrated), a shaft 540 passes through the dials 510, and a first gear 512 disposed on one side of each dial 510. The combination lock 500 further includes a plurality of bushings 530 (only one of them being illustrated), a contact block 520, a sleeve 550, and a positioning block 560. A first resilient element 548 is mounted on one end of the shaft 540, and the shaft 540 then sleeves into the sleeve 550 through the first resilient element 548. A plurality of protruding portions 542 is disposed in a line on the surface of the shaft 540. The number of the protruding portions 542 corresponds to the number of the bushings 530. In this embodiment, two rows of protruding portions are preferably disposed on opposite sides of the shaft 540 to engage with each bushing 530 more firmly. The bushings 530 may be selectively engaged or moved between the protruding portions 542 and the dials 510. One end of the contact block 520 contacts with a rotatable slider 220 of the activation device 200 (preferably touching against the blocking portion 222), and the other end engages with the shaft 540. A second resilient element 552 is provided on one end of the sleeve 550 in a manner that two ends of the second resilient element 552 contact with the bushing 530 and the positioning block 560, respectively. The first resilient element 548 is preferably mounted on a rectangular extension 546 of the shaft 540 and configured to push the bushings 530 to move. The positioning block 560 is fixed on the positioning device 110 to position the combination lock 500. The first resilient element 548 and the second resilient element 552 are preferably a spiral spring or a compression spring. However, in other embodiments, the first resilient element 548 and the second resilient element 552 can be an anti-force spring, helical/coil spring, or other resilient elements as appropriate.

When the combination lock 500 is in a locked configuration, the protruding portions 542 of the shaft 540 restrict displacements of the bushings 530 and the dials 510, so that the password of the combination lock 500 cannot be changed, wherein the first and second resilient elements 548, 552 are both in compression state. When the combination lock 500 is in an unlocked configuration, the shaft 540 is released (due to the resilient forces of the first and second resilient elements 548, 552) to allow the bushings 530 to disengage from the apertures 522 of the dials 510, so that the dials 510 can be operated to reset a new password. After the shaft 540 is pushed back enabling the bushings 530 to engage with the apertures 522 of the dials, the setting of password is completed. The technical spirit of the combination lock 500 and the operation of setting the password are well-known in the art and will not be elaborated.

In the embodiment shown in FIG. 2A, the first gear 512 includes a plurality of aligning teeth 514, a missing tooth 516, and a block tooth 518. The missing tooth 516 is formed between the block tooth 518 and one of the aligning teeth 514, such as the first one of the aligning teeth 514. That is, the missing tooth 516 is a blank area of the first gear 512 where a tooth is missing. The block tooth 518 is disposed between the missing tooth 516 and one of the aligning teeth 514, such as the last one of the aligning teeth 514. The size (e.g. width) of the block tooth 518 is preferably greater than that of each aligning tooth 514. The number of teeth of the first gear 512 is preferably eight teeth (including seven aligning teeth 514 and one block tooth 517, except the missing tooth 516) to correspond to the dial 510 having ten numbers (e.g. 0 to 9). Moreover, the first gear 512 is preferably integrally formed with the dial 510 around the aperture 522, and the diameter of the first gear 512 is smaller than the diameter of dial 510. In the embodiment, when all dials 510 display "0" or any other predetermined number on the holes 160, the combination lock 500 is defined in an auto-reset or Zero-setting position. That is, when the second gear 710 runs free with the missing tooth 516 of the first gear 512, the corresponding number of each dial 510 is automatically determined so that the combination lock 500 is defined to be in the auto-reset position. In this embodiment, "0" is the number of each dial 510 shown on the hole 160 when the second gear 710 runs free with the missing tooth 516 of the first gear 512, so that the combination lock 500 is also defined as in the Zero-setting position. However, in other embodiments, the dials 510 may be set to display any predetermined number on the holes 160 when in the auto-reset position, according to the position of the holes 160 or the definition of Zero-setting or auto-reset. For example, when the definition of auto-reset or Zero-setting is to show "7" or other number such as "1", "2", "3", "4", . . . , or "9" on the hole 160, the second gear 710 runs free with the missing tooth 516 of the first gear 512, so that the number "7" (or other predetermined number) of the dial 510 can be shown on the hole 160. Alternatively, by changing the position of the hole 160, the number shown on the hole 160 can be adjusted, and the number representing the auto-reset can be accordingly modified. The detailed interactions of the first gear 512 and the second gear 710 will be described latter.

Figure 2B:
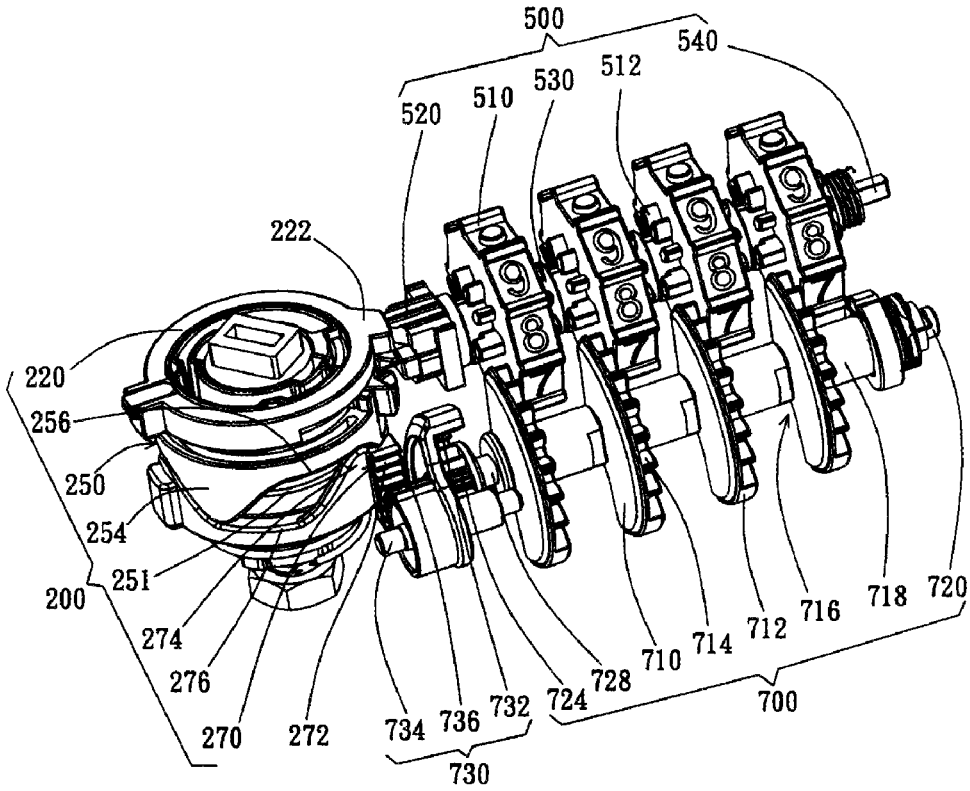
FIG. 2B illustrates a schematic view of the combination lock wherein the activation device is connected to the setting device via a linking element.

The setting device 700 has a plurality of second gears 710 corresponding to the first gears 512, a setting shaft 720, and a linking element 730. One end of the setting shaft 720 passes through the axial hole of the second gear 710 and the other end is connected to the activation device 200. In the embodiment, the setting shaft 720 is preferably connected to the activation device 200 via the linking element 730. In other embodiments, however, the setting shaft 720 may connect to the activation device 200 directly. The setting shaft 720 includes a toothed bar 724 on one end and at least one convex portion 722 disposed on the surface of the setting shaft 720. The convex portion 722 can be a protruded line extending along the lengthwise direction of the setting shaft 720. As FIGS. 2A and 2B show, the linking element 730 includes a first linking gear 732, a second linking gear 736, and a linking shaft 734 linked to the first and second linking gear 732, 736 serving as an axle. Therefore, in the embodiment shown in FIG. 2B, the toothed bar 724 of the setting shaft 720 is preferably engaged with the first linking gear 732 of the linking element 730 to drive the second gear 710 to rotate. That is, the setting shaft 720 and the linking shaft 734 are eccentric to drive the setting shaft 720 to rotate. The second linking gear 736 of the linking element 730 further connects to the activation device 200 to complete the connection of the structure.

As FIG. 2A and FIG. 2B show, the second gears 710 are equidistantly arranged with a spacer 718 in-between. Each spacer 718 is formed with a groove 719 on an inner wall thereof to correspond to the convex portion 722, so that the second gears 710 and the spacers 718 can move in response to the movement of the setting shaft 720. In the embodiment, the second gear 710 is preferably integrally formed with the spacer 718. The second gear 710 further has an arc tooth 712, a plurality of setting teeth 714, and a toothless portion 716. The size (e.g. width) of the arc tooth 712 is greater than that of the setting tooth 714 to prevent from continuous rotation by blocking the block tooth 518 of the first gear 512. The toothless portion 716 can prevent the second gear 710 from being driven by the first gear 512 to turn the setting device 700 when the dials 510 turn. In the embodiment, each second gear 710 is formed as a sector gear consisting of the setting teeth 714 and the arc tooth 712. In other embodiment, however, the setting tooth 714 and the arc tooth 712 can be formed in any other irregular shapes or different forms.

The setting device 700 further includes a resilient element 740, a setting sleeve 742, a first positioning plate 726, and a second positioning plate 750. One end of the setting shaft 720 is sleeved into the setting sleeve 742 and touches against the second positioning plate 750. One end of the resilient element 740 is mounted on one end of the setting sleeve 742, and the other end of the resilient element 740 contacts with the second positioning plate 750. The resilient element 740 is preferably a torque spring or an element similar to a torsional spring for increasing the returning force of the second gear 710 when being driven by the setting shaft 720. The first positioning plate 726 is preferably disposed on a groove 728 which is formed close to the toothed bar 724 of the setting shaft 720. The first positioning plate 726 has an opening 727 to allow the linking shaft 734 to pass therethrough to facilitate stable rotations of the setting shaft 720 and the linking shaft 734. The setting device 700 is partially accommodated on one side of the positioning device 110 corresponding to the combination lock 500, and the second positioning plate 750 is fixed on the positioning device 110 to position the setting device 700.

Figure 1B:
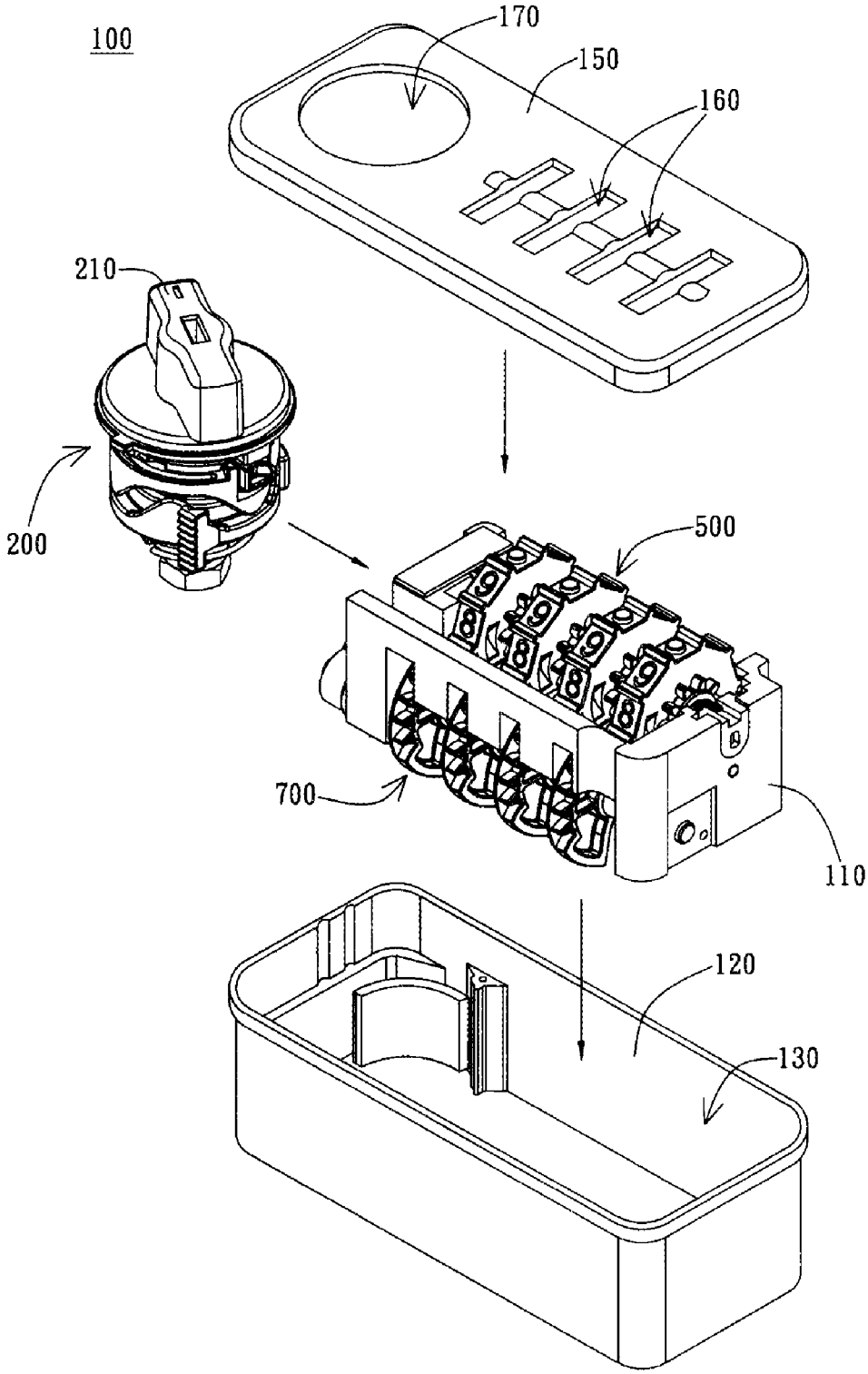
FIG. 1B illustrates a partially exploded view of the lock structure according to present invention.

As FIG. 1B and FIG. 2A show, the activation device 200 is disposed on one side of the positioning device 110 and connects with the combination lock 500 and the setting device 700. The activation device 200 includes a knob 210 having a key hole 302, a rotatable slider 220, an activation sleeve 250, a lock core 240 having a plurality of lock tongues 242 (only one of them being illustrated), and a sliding sleeve 270. The activation sleeve 250 includes a sleeve portion 251, a plurality of first lugs 254 formed on the outer surface of the sleeve portion 251, and at least one first smooth portion 256 connected between the first lugs 254. In other words, the first lug 254 is formed on the outer wall of the sleeve portion 251 and is preferably an extension having a smooth wavy contour along the axial direction of the activation sleeve 250. That is, the first lug 254 can have a shape similar to an inverted triangle. The lock core 240 is disposed in the through hole 262 of the activation sleeve 250 in a manner that the lock tongue 242 is positioned on a notch 264 formed on one side of the activation sleeve 250. The knob 210 has a recess portion (not illustrated) formed on bottom of the knob 210. A protruding portion 252 formed on top of the lock core 240 corresponds to and engages with the recess portion of the knob 210. Thus, when the knob 210 turns, the lock core 240 of the activation sleeve 250 can be driven to rotate together. The rotatable slider 220 is disposed between the knob 210 and the activation sleeve 250 and on the top edge of the activation sleeve 250 to selectively rotate with the knob 210. In the embodiment, the rotatable slider 220 is preferably a ring-shape, and the activation sleeve 250 is a hollow cylinder. The rotatable slider 220 further has a blocking portion 222, a chute 224, and a passive portion 226. The blocking portion 222 is provided for contacting with the contact block 520 of the combination lock 500. The chute 224 corresponds to a step portion 260 of the activation sleeve 250, and the passive portion 226 is disposed corresponding to a pushing portion 258 of the activation sleeve 250. When the knob 210 rotates by a certain angle driving the rotatable slider 220, the pushing portion 258 will push the passive portion 226 to drive the rotatable slider 220 to rotate. Therefore, the blocking portion 222 is capable of releasing the contact block 520 to displace the shaft 540 of the combination lock 500.

Please also refer to FIG. 2B, the vertex of each first lug 254 is located on a circumference of a virtual circle around the activation sleeve 250 and spaced apart from each other by an angle. In the embodiment, the angle is preferably 120 degrees, i.e., three first lugs 254 of inverted triangle are disposed around the activation sleeve 250. The sliding sleeve 270 has a plurality of second lugs 274, at least one second smooth portion 276 connected between the second lugs 274, and a driving portion 272. Each second lug 274 and each second smooth portion 276 are corresponding to each first lug 254 and each first smooth portion 256, respectively. Thus, when the first lug 254 rotates, the second lug 274 can smoothly move corresponding to the first lug 254 and the first smooth portion 256. In other words, when the knob 210 turns to drive the activation sleeve 250 to rotate, the first lug 254 will be turned to drive the second lug 274, so that the sliding sleeve 270 can move correspondingly and a vertical displacement of the sliding sleeve 270 with respect to the activation sleeve 250 can be generated. Meanwhile, the driving portion 272 disposed on one side of the sliding sleeve 270 drives the second linking gear 376 of the linking element 730 to drive the setting shaft 720, so as to activate the setting device 700. In the embodiment, the driving portion 272 is preferably a rack. In other embodiments, however, the driving portion 272 may be a ratchet, a serration portion, or other elements suitable for driving the linking element 730.

The activation device 200 further includes a second resilient element 290 and an assembly member 280. The second resilient element 290 is disposed in an inner hole of the sliding sleeve 270 to contact with an end of the inner hole of the sliding sleeve 270 and provides the sliding sleeve 270 with a force to move upwards. The second resilient element 290 is preferably a helical spring, a compression spring, or other elastic elements as appropriate. The assembly member 280 preferably consists of a screw 282 having a second concave portion 286 and a nut 284. The second concave portion 286 is disposed on top end of the screw 282 for engaging with the second protruding portion 246 of the lock core 240, which is disposed on the other end opposite to the first protruding portion 252. The screw 282 further has a male thread 288 for engaging with a female thread 289 of the nut 284. In other embodiments, however, the assembly member 280 may consist of a bolt and a nut or other combinations of similar elements.

Figure 3:
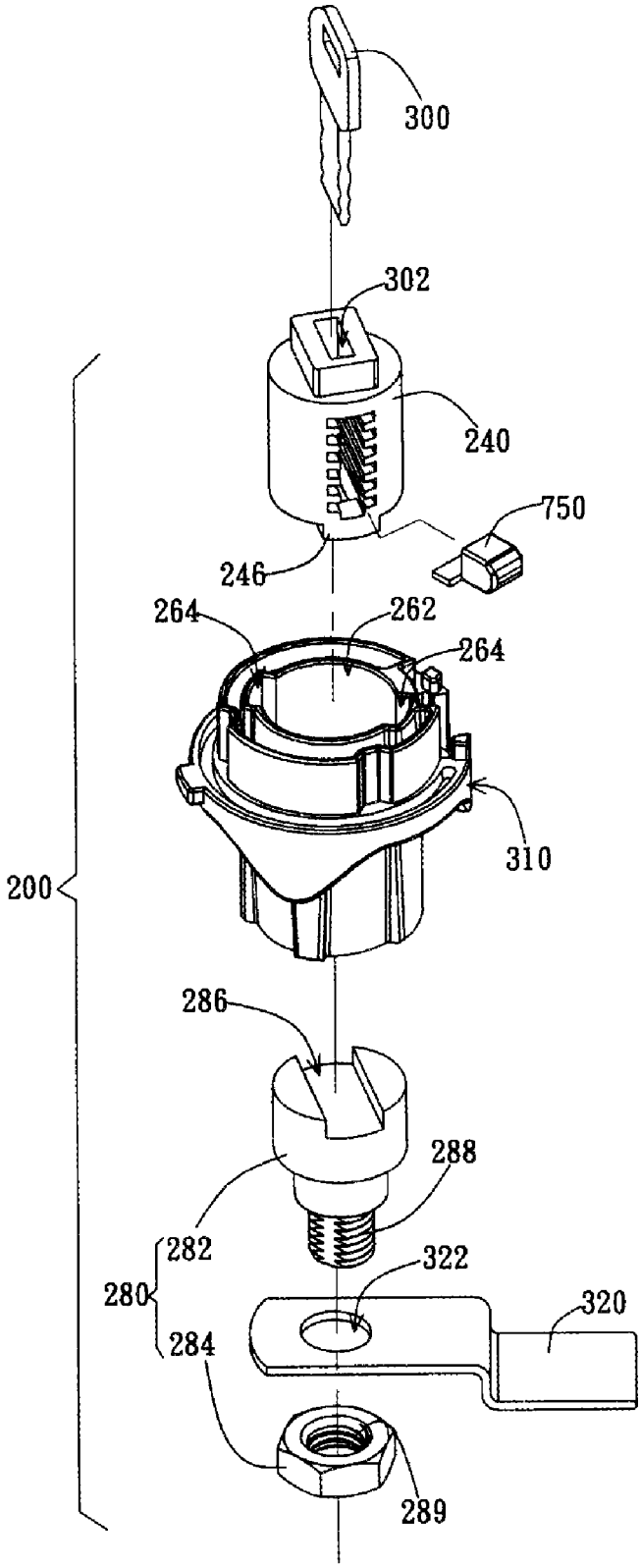
FIG. 3 illustrates an exploded view of a key lock of the present invention.

As FIG. 3 shows, the activation device 200 may be configured to include a key lock which is operable by a key 300. Similarly, the key lock has the lock core 240, a lock core sleeve 310, and the assembly member 280 for fixing a shield 320. The through hole 262 of the lock core sleeve 310 is formed with two opposite notches 264 for engaging with a plurality of lock tongues 750 (only one of them being illustrated) of the lock core 240. The lock core 240 is accommodated in the through hole 262 of the lock core sleeve 310 and the lower end thereof is connected to the assembly member 280. In the embodiment, the bottom end of the lock core 240 has the second protruding portion 246 which passes through the through hole 262 to engage with the concave portion 286 of the screw 282. Therefore, when the key 300 is inserted into the key hole 302 to turn the lock core sleeve 310, the assembly member 280 will rotate and drive the shield 320 to rotate directly. The assembly member 280 preferably consists of a screw 282 and a nut 284. By inserting the screw 282 through the aperture 322 of the shield 320 to engage the male thread 288 of the screw 282 with the female thread 289 of the nut 284, the shield 320 can be fixed between the screw 282 and the nut 284. In other embodiments, however, the assembly member 280 may include a combination of a bolt and a nut or other elements such as a rivet, a plug, or a pin or for directly positioning the shield 320.

When the key lock is in a locked configuration, the lock tongue 750 is engaged with one of the notches 264, such that the assembly member 280 and the shield 320 cannot rotate. In this moment, the shield 320 should be at a locked position/state. On the contrary, when the key 300 is inserted into the lock hole 302 to turn the lock core 240, the lock tongue 750 will retract and disengage from the notch 264. In the moment, the lock tongue 750 of the lock core 240 turns to the notch 264 on opposite side and drives the assembly member 280 to rotate together. Thus, the shield 320 is driven to rotate to an unlocked position/state. In this operation, the combination lock 500 and the setting device 700 remain unaffected. In other words, the key lock and the combination lock 500 are operated independently, so that operating the activation device 200 by the key 300 just simply turns the lock core 240 to rotate the assembly member 280 and control the locked or unlocked position of the shield 320.

Figure 4A:
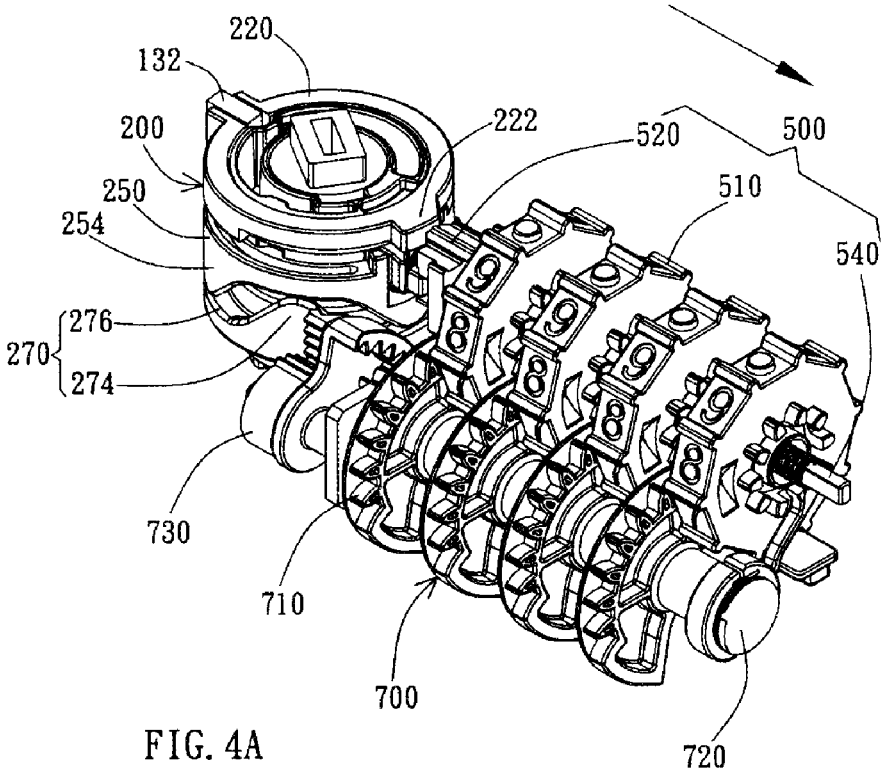
FIG. 4A illustrates a perspective view of the combination lock in a locked configuration according to the present invention, wherein the activation device cannot rotate.
Figure 4B:
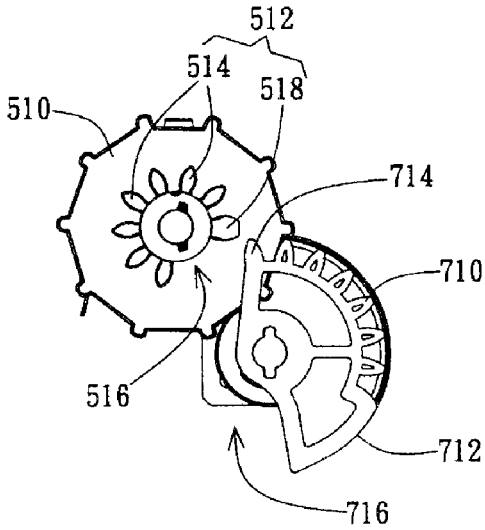
FIG. 4B is a schematic partial view of FIG. 4A showing the relative position of the first gear and the second gear.

Hereinafter, the operation of the combination lock 500 and the setting device 700 will be described in detail. As FIG. 4A and FIG. 4B show, when the combination lock 500 is in the locked configuration, the blocking portion 222 of the rotatable slider 220 contacts with the contact block 520 of the shaft 540 so that the knob 210 and the shaft 540 immovably touch against each other. That is, when the combination lock 500 is in the locked configuration, the activation device 200 is constrained by the shaft 540 and is not rotatable. Meanwhile, the second gear 710 of the setting device 700 disengages from the first gear 512 of the combination lock 500, so that the second gear 710 cannot rotate when the dials 510 are operated by the user. That is, the first gear 512 rotates with respect to the toothless portion 716 of the second gear 710, so that the dials 510 can be freely operated/rotated without driving the second gear 710 to rotate as well. As shown in FIG. 4A, the first lugs 254 of activation sleeve 250 are preferably located or disposed corresponding to the second smooth portion 276 of the sliding sleeve 270. The second lugs 274 are now at the highest position, and the second resilient element (not illustrated) is compressed.

Figure 4C:
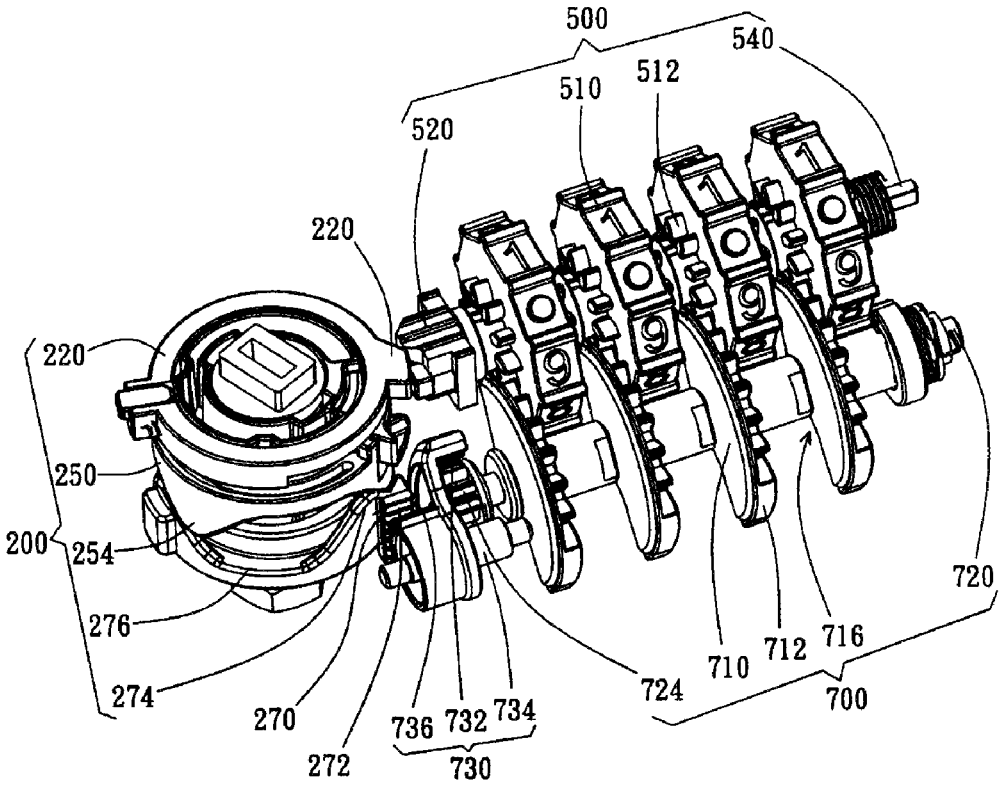
FIG. 4C illustrates a perspective view of the combination lock in an unlocked configuration, wherein the activation device starts to rotate.
Figure 4D:
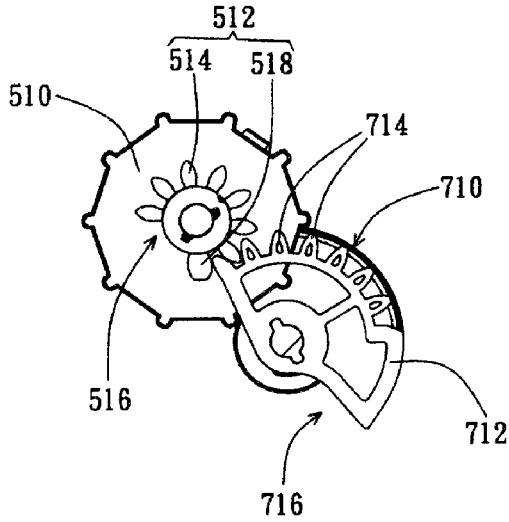
FIG. 4D is a schematic partial view of FIG. 4C showing the relative position of the first gear and the second gear.

As FIGS. 4C and 4D show, when each dial 510 turns to the correct number (namely the combination lock 500 is unlocked and in an unlocked configuration), the knob of the activation device 200 can be operable/rotatable to release the blocking portion 222 of the rotatable slider 220 from the contact block 520 of the shaft 540. Please also refer to FIG. 5A, at this stage, the first spring 548 and the second spring (not illustrated) can provide elastic forces to push the shaft 540 and bushings 530 to move toward the activation device 200, and each bushing 530 is thus disengaged from each dial 510. In the embodiment shown in FIGS. 4C, 4D, and 5A, when the first lug 254 of the activation sleeve 250 starts to move and drives the second lug 274, the driving portion 272 of the sliding sleeve 270 drives the setting device 700 to rotate via the linking element 730. In other words, when the driving portion 272 moves downwardly to drive the second linking gear 736 of the linking element 730 to rotate, the toothed bar 724 of the setting shaft 720 will be correspondingly driven by the first linking gear 732, so that the setting shaft 720 and the linking shaft 734 are eccentric to drive the setting shaft 720 to rotate. As FIG. 4D shows, the setting tooth 714 of the second gear 710 starts to engage with the aligning tooth 514 of the first gear 512.

Figure 5A:
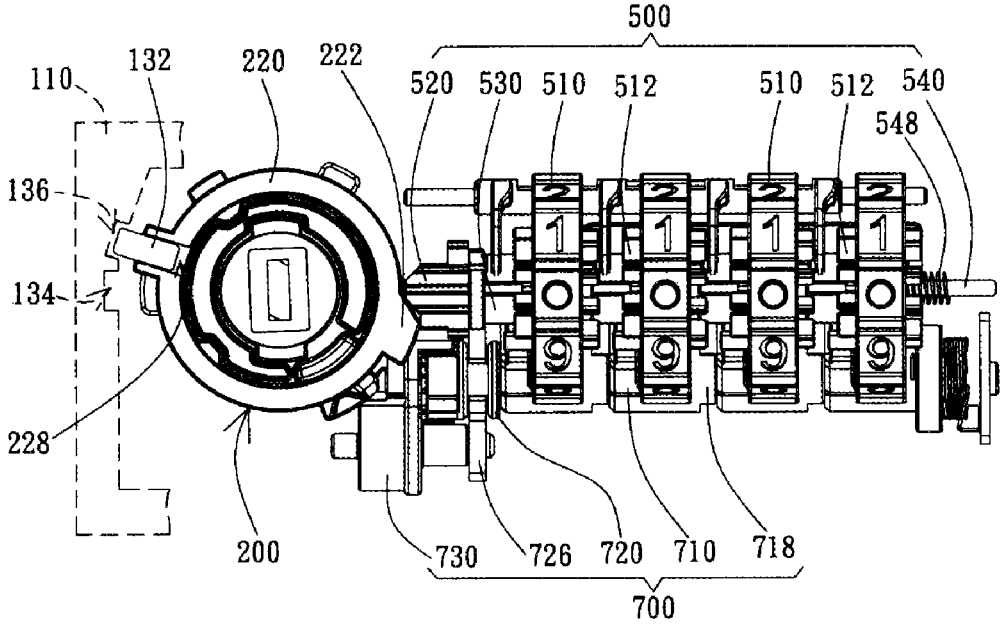
FIG. 5A illustrates a top view of the combination lock in the unlocked configuration according to the present invention, wherein the activation device turns to a first position.
Figure 5B:
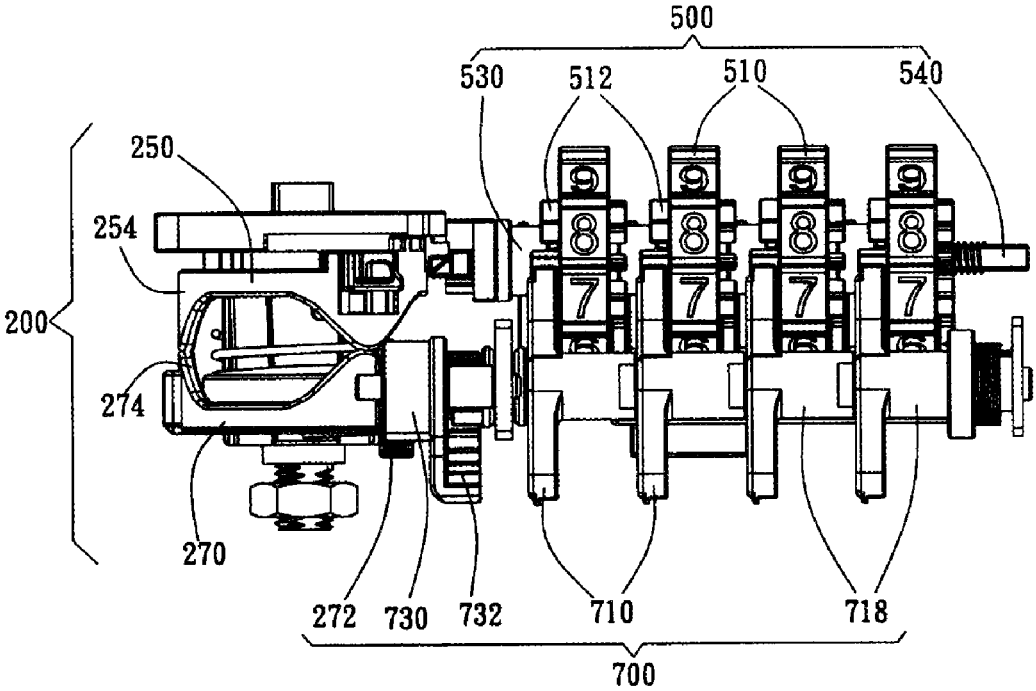
FIG. 5B illustrates a side view of the combination lock in the unlocked configuration according to the present invention, wherein the activation device rotates to the first position.
Figure 5C:
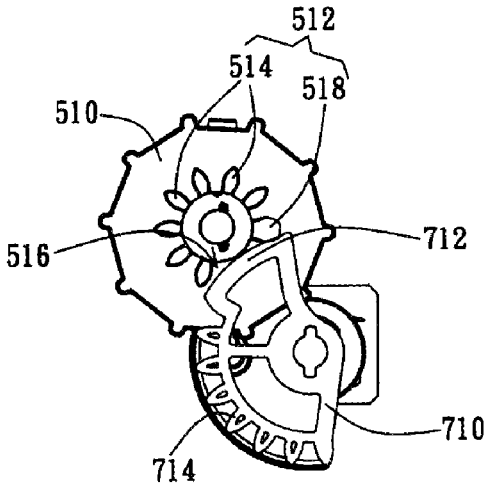
FIG. 5C is a schematic partial view of FIG. 5B showing the relative position of the first gear and the second gear.
Figure 5D:
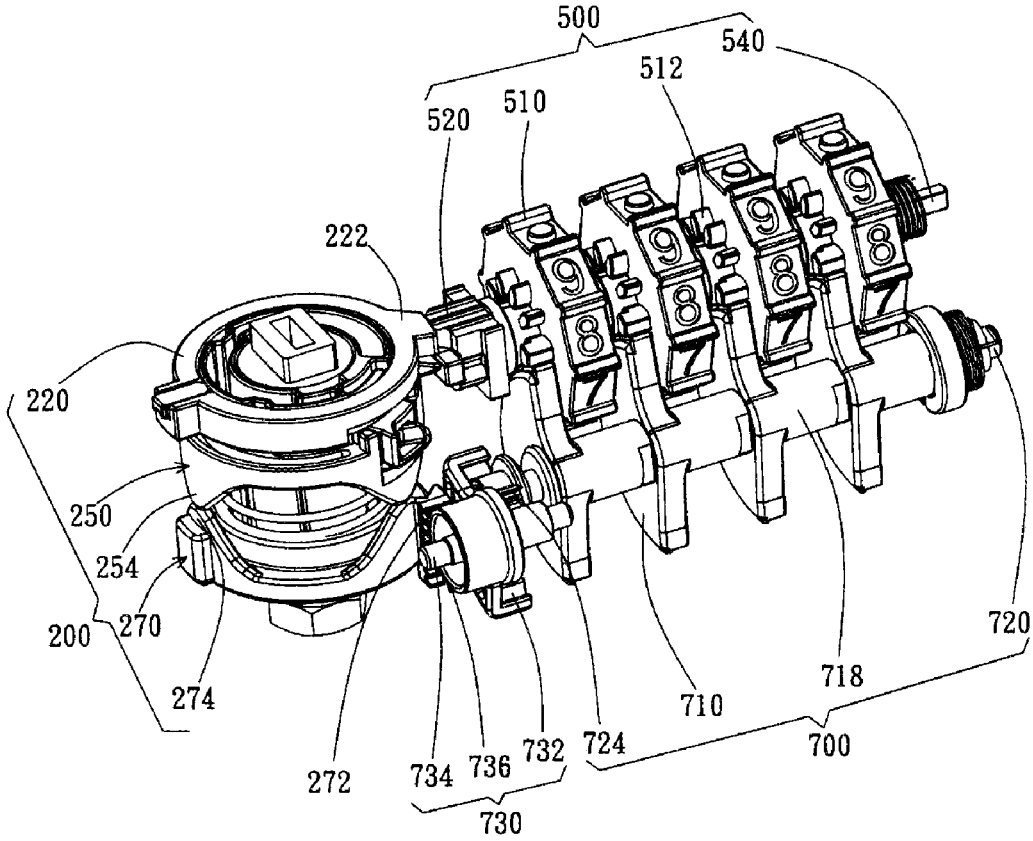
FIG. 5D illustrates a schematic view of the combination lock wherein the activation device is connected to the setting device via a linking element.

Please refer to FIGS. 5B, 5C, and 5D, when the activation sleeve 250 of the activation device 200 rotates to push the sliding sleeve 270 downwardly to the lowest position, the second gear 710 of the setting device 700 will rotate a maximum degree (about 180 disagrees.) In other words, when the vertex of the first lug 254 of the activation device 250 moves to the vertex of the second lug 274 of the sliding sleeve 270, the driving portion 272 will drive the second linking gear (not illustrated) of the linking element 730 to rotate and accordingly, the second gear 710 of the setting device 700 is driven to rotate the first gear 512 of the combination lock 500, enabling the dials 510 to be in the auto-reset or Zero-setting position, and the password of the combination lock 500 can be reset. As FIG. 5A shows, a positioning block 132 moves from a first locating groove 134 of the positioning device 110 to a second locating groove 136 to release the contact block 520. In other words, the positioning block 132 disposed on the recess 228 of the rotatable slider 220 is preferably configured to restrict or release the axial movement of the shaft 540. Moreover, when the rotatable slider 220 reversely rotates, the positioning block 132 will return to the first locating groove 134 and restricts movement of the contact block 520.

When the knob 210 turns, for example, about 20 to 60 degrees, as shown in FIG. 5C, the arc tooth 712 of the second gear 710 contacts with and is blocked by the block tooth 518 of the first gear 512. That is, the arc tooth 712 is positioned between the block tooth 518 and the aligning tooth 514 (e.g. at the area where the missing tooth 516 is located) of the first gear 512, so that the second gear 710 cannot be further rotated. During the operation of auto-reset the combination lock 500, the setting tooth 714 will engage with the aligning tooth 514 one by one and the number of the dial 510 shown on the hole 160 will correspondingly change until the arc tooth 714 engages with the block tooth 518 (i.e. corresponds to the missing tooth 516). Moreover, no matter what tooth of the second gear 710 first engages with the aligning tooth 514, when the setting tooth 714 once runs free with the missing tooth 516, the dial 510 runs idle, i.e., is non-rotatable, and the number shown on the hole 160 is the predetermined number defined for the auto-reset or Zero-setting position. For example, in this embodiment, the number of the dial 510 displayed on the hole is "0", but not limited thereto.

Figure 6A:
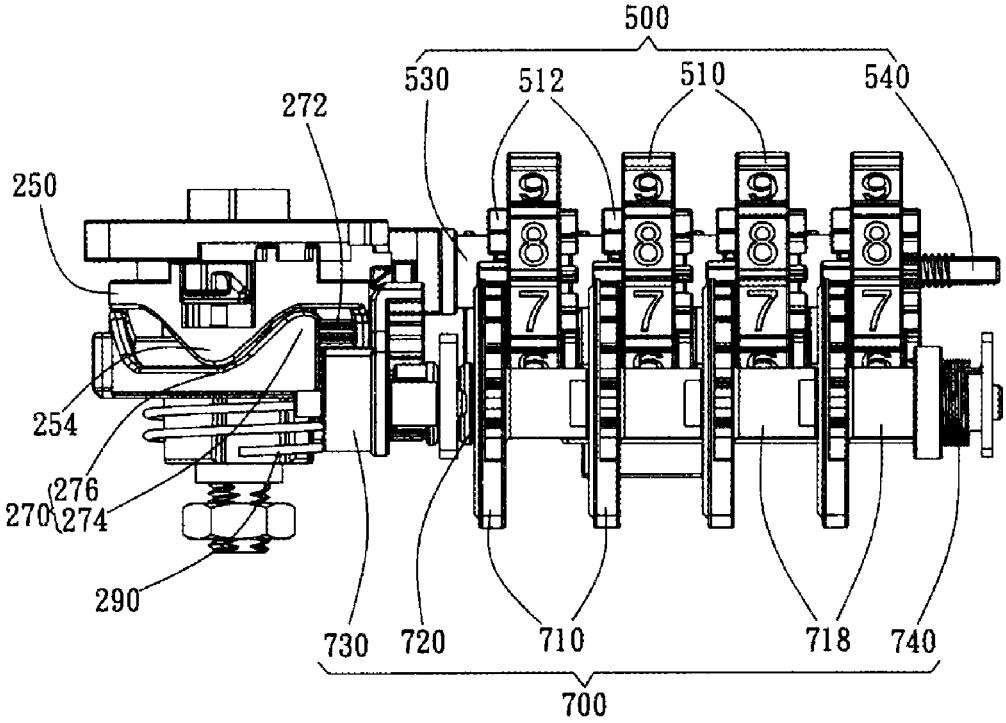
FIG. 6A illustrates a side view of the combination lock in the unlocked configuration according to the present invention, wherein the activation device rotates to a second position.
Figure 6B:
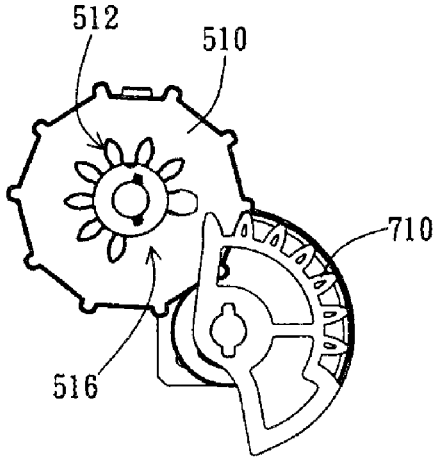
FIG. 6B is a schematic partial view of FIG. 6A showing the relative position of the first gear and the second gear.

When the knob keeps on turning about 100 to 120 degrees, as shown in FIG. 6A and FIG. 6B, the first lug 254 moves from the second lug 274 to the second smooth portion 276, i.e., the second lug 274 of the sliding sleeve 270 moves upwards to the highest position, so that the second gear 710 of the setting device 700 will return to its initial position as shown in FIG. 4B. During this operation, the second resilient element 290 of the activation device 200 will provide the sliding sleeve 270 with a force moving upwards, and the resilient element 740 will also provide the second gear 710 of the setting device 700 with a returning force. In the embodiment shown in FIG. 6A, the driving portion 272 preferably moves from the lowest position to the highest position, such that the linking element 730 drives the second gear 710 of the setting device 700 to return to its initial position. Furthermore, once the first gear 512 stops at the missing tooth 516 and disengages from the second gear 710, the first gear 512 will not rotate in response to the returning action of the second gear 710. As such, the auto-reset operation is accomplished, and the combination lock 500 can be reset a new password.

When the new password setting is accomplished by the user, the combination lock 500 can be further operated to be in the locked configuration. In other words, the user turns the dials 510 to set the password and then turns the knob 210 reversely (i.e., counterclockwise in the embodiment), so that the combination lock 500 can be in the locked configuration. In other embodiments, however, the knob may turn in a direction same as unlocking the combination lock 500.

Figure 7:
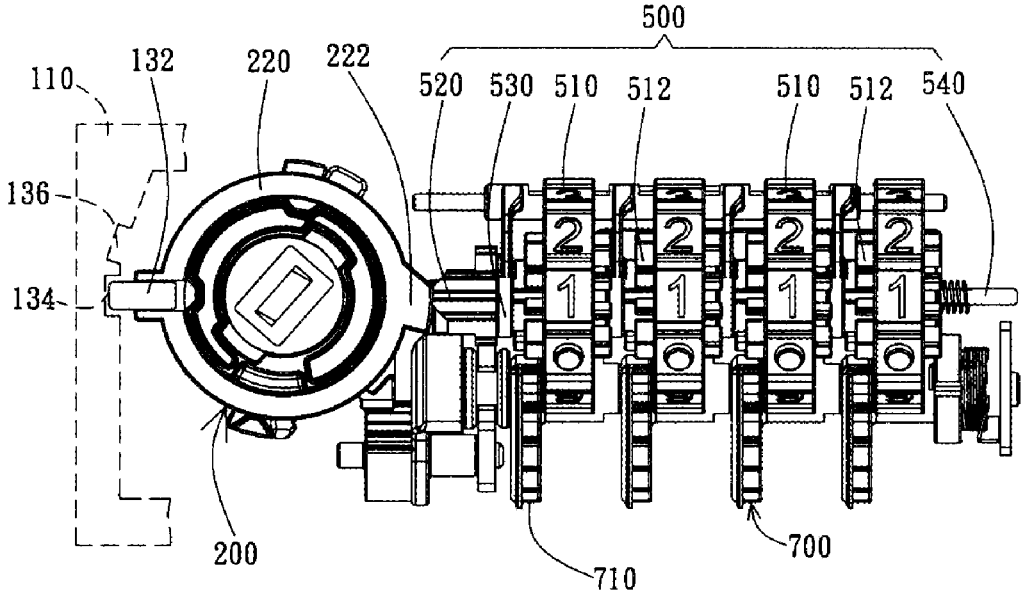
FIG. 7 illustrates a top view of the combination lock in the unlocked configuration according to the present invention, wherein the activation device rotates to a third position.

As FIG. 7 shows, when the knob reversely turns a certain angle, such as from 120 degrees to 0 degree, the rotatable slider 220 of the activation device 200 return to its previous position, so that the blocking portion 222 of the rotatable slider 220 touches against the contact block 520 of the shaft 540 to move the bushing 530 to be engaged with the dial 510. Therefore, the new password will be set/decided and the combination of numbers indicating the new password is presented on the holes. In the embodiment shown in FIG. 7, the positioning block 132 will move from the second locating groove 136 to the first locating groove 134. In addition, the second gear 710 of the setting device 700 does not contact with the first gear 512 of the combination lock 500, referring to FIG. 6B.

If the knob keeps rotating, the second gear 710 of the setting device 700 will drive the first gear 512 of the combination lock 500 to rotate, so that the number of the dial 510 will automatically turn to the predetermined number, i.e., to the auto-reset or Zero-setting position, in a manner similar to the operation of shown in FIGS. 5A-5D. Therefore, after the password of the combination lock 500 is reset, by simply turning the knob 210, the action of randomly messing up the dials 510 is not necessary, which results in a convenient operation and saves the operation time. As shown in FIG. 5A to FIG. 5D, during the operation of auto-reset the dials 510, the first lug 254 is activated to drive the second lug 274 to move from the highest position to the lowest position, and the second gear 710 is driven to rotate about 180 degrees.

When the first lug 254 moves from the highest point of the second lug 274 to the lowest position of the second smooth portion 276, the second gear 710 of the setting device 700 is driven by the linking element 730 to reversely rotate 180 degrees to its initial position in a manner similar to the embodiment shown in FIG. 6A and FIG. 6B. In addition, the knob may keeps turning to the locked position, as shown in FIG. 4A. Consequently, the operation of the lock structure illustrated in the above embodiments can be repeated to change or reset the new password more easily.

Figure 8A:
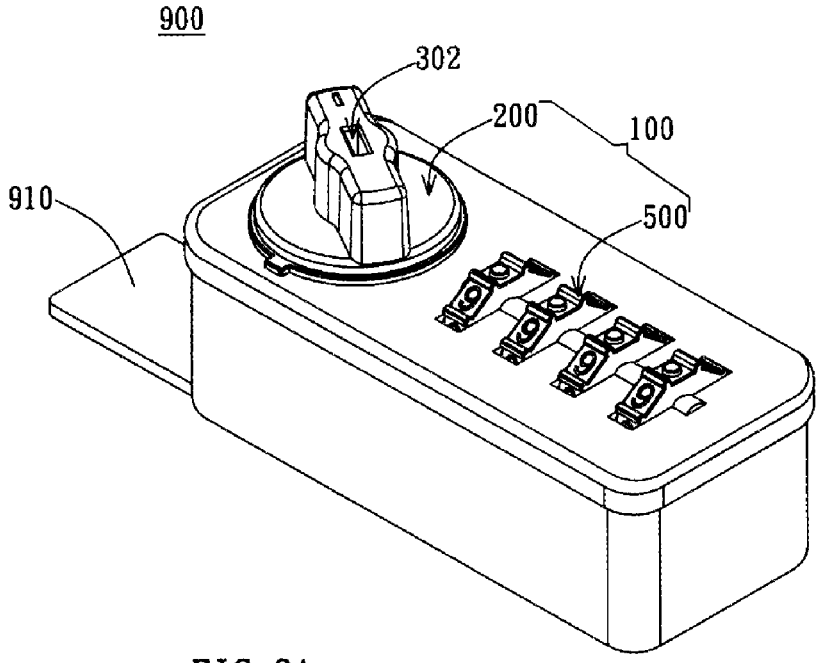
FIG. 8A illustrates a perspective view of a cabinet lock of the present invention.
Figure 8B:
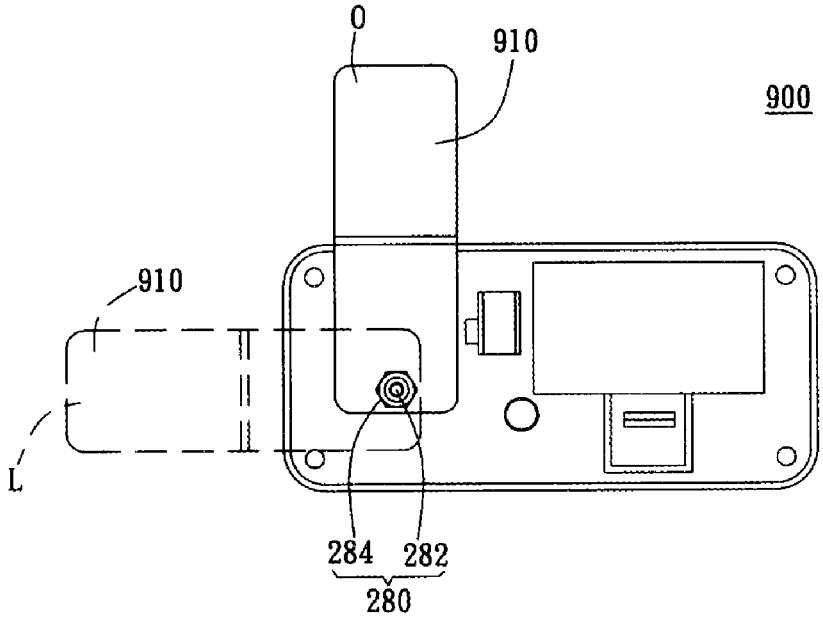
FIG. 8B illustrates a schematic view of the cabinet lock of the present invention.

The present invention further provides a cabinet lock 900 employed the lock structure 100 as described above. As FIG. 8A and FIG. 8B show, the cabinet lock 900 includes an activation device 200 having a rotatable shield 910, a combination lock 500, and a setting device (not illustrated.) The shield 910 is preferably positioned by the assembly member 280. In the embodiment shown in FIG. 8B, the assembly member 280 preferably consists of a screw 282 and a nut 284, and the shield 910 is preferably positioned between the screw 282 and the nut 284. When the activation device 200 turns to the unlocked position and the combination lock 500 is unlocked, the shield 910 can rotate from the locked position L to the unlocked position O allowing access to the cabinet. On the contrary, when the activation device 200 turns to the locked position and the combination lock 500 is locked, the shield 910 can rotate from the unlocked position O to the locked position L preventing unauthorized access to the cabinet. With regard to the details of the activation device 200, the combination lock 500, and the setting device and the connections thereof, please refer to the above-mentioned embodiments.

Similarly, when the activation device 200 moves to the unlocked position and drives the second gear 710 to rotate the first gear 512 causing the second gear 710 to run free with the missing tooth 516, the dials 510 are automatically reset to the auto-reset position and the new password can be reset. When the activation device 200 moves to the locked position and drives the second gear 710 to rotate the first gear 512 reversely causing the second gear 710 to run free with the missing gear 516, the dials 510 are automatically reset to the auto-reset position.

Therefore, when the activation device 200 rotates clockwise to the unlocked position, the combination lock can be reset a new password. When the activation device 200 rotates counterclockwise to the locked position, the new password of the combination lock 500 is effective and the dials 510 automatically return to the auto-reset position. Moreover, in this embodiment, by inserting the key (not illustrated) kept by the manager or the cabinet owner into the key hole 302, the activation device 200 can be operated to drive the shield 910 to the unlocked position O or the locked position L. That is, the cabinet lock 900 of the present invention can be operated by operating the key lock of the lock structure 100.

From the foregoing, it shall be appreciated that specific embodiments of the invention have been described herein for purposes of illustration, but that various modifications and alterations may be made by those skilled in the art without deviating from the spirit and scope of the invention. For example, it shall be understood that there is no intention to limit the invention to the specific forms disclosed, but on the contrary, the invention is to cover all modifications, alternate constructions and equivalents falling within the spirit and scope of the invention. Accordingly, the invention is not limited except as by the appended claims.

We claim:

1. A lock structure, comprising:

an activation device, operably provided;

a combination lock, selectively being in an unlocked configuration and a locked configuration, having a plurality of dials, a shaft passing through the dials, and a plurality of first gears each disposed on one side of one of the plurality of dials, wherein each first gear includes a missing tooth, one end of the shaft is connected to the activation device;

a setting device having a plurality of second gears corresponding to the first gears and a setting shaft, wherein one end of the setting shaft passes through the second gears and the other end is connected to the activation device;

wherein the combination lock in the unlocked configuration allows the activation device to be operated to drive the second gears to rotate the first gears, and each second gear further runs free with the missing tooth of each first gear so that the dials are in a predetermined position; the activation device is further allowed to be operated to bring the combination lock to the locked configuration and drives the second gears to rotate the first gears, and each second gear further runs free with the missing tooth of each first gear, the dials are in a predetermined setting position.

2. The lock structure of claim 1, wherein the combination lock further includes:

a plurality of protruding portions arranged side by side on the shaft; and a plurality of bushings selectively engaged with the protruding portions, wherein the plurality of bushings is movable along the shaft to position or release the shaft.

3. The lock structure of claim 1, wherein each first gear includes a series of aligning teeth and a block tooth, the missing tooth is formed between the block tooth and a first one of the series of aligning teeth, the block tooth is disposed between the missing tooth and the last one of the series of aligning teeth, and the size of the block tooth is greater than that of each aligning tooth.

4. The lock structure of claim 1, wherein each first gear and each dial are integrally formed, the diameter of the first gear is smaller than the diameter of the dial.

5. The lock structure of claim 1, wherein each second gear has an arc tooth, a plurality of setting teeth, and a toothless portion, the size of the arc tooth is greater than that of each one of the plurality of the setting teeth to prevent the second gear from engaging with a corresponding one of the first gears, and when one of the first gears rotates, the toothless portion prevents a corresponding one of the second gears from engaging with the first gear.

6. The lock structure of claim 5, wherein each second gear is formed as a sector gear consisting of the setting teeth and the arc tooth.

7. The lock structure of claim 1, wherein the setting device further includes:

at least one convex portion disposed on the setting shaft;

a linking element, selectively driven by the activation device, having one end connected to the setting shaft and the other end connected to the activation device; and a plurality of spacers equidistantly linking each second gear, an inner wall of the spacers having at least one groove corresponding to the convex portion, wherein when the linking element is driven by the activation device to drive the setting shaft to rotate, the convex portions of the setting shaft engage with the grooves of the spacers to rotate the second gears synchronously.

8. The lock structure of claim 7, wherein the linking element has a linking gear and a linking shaft, the linking gear rotates about the linking shaft, one end of the setting shaft has a toothed bar engaged with the linking gear, the setting shaft and the linking shaft are eccentric, and the setting shaft is driven by the linking gear to rotate.

9. The lock structure of claim 7, wherein the setting device further includes a first resilient element disposed on the other end of the setting shaft for increasing the returning force of the second gears.

10. The lock structure of claim 1, wherein the activation device further includes:

a knob having a recess portion, the knob turnably disposed on one side of a positioning device;

a rotatable slider disposed under the knob, the rotatable slider having a blocking portion for contacting one end of the shaft of the combination lock;

an activation sleeve having a protruding portion and a plurality of first lugs, wherein the protruding portion corresponds to the recess portion, and the first lugs are disposed at different angles, respectively; and a sliding sleeve having a plurality of second lugs and a driving portion, wherein the second lugs are disposed corresponding to the first lugs, and the driving portion is disposed on one side of the sliding sleeve;

wherein when the knob turns, the first lugs of the activation sleeve are rotated to move the second lugs vertically, such that the driving portion drives the second gears of the setting device to rotate via the linking element.

11. The lock structure of claim 10, wherein the driving portion includes a rack, the linking element includes a second linking gear for engaging with the rack.

12. The lock structure of claim 10, wherein the rotatable slider includes a chute and a passive portion, the activation sleeve includes a pushing portion and a step portion, the chute is disposed corresponding to the step portion to freely move on the step portion, and the passive portion is moved by the pushing portion.

13. The lock structure of claim 10, wherein the activation sleeve further includes a through hole and a second resilient element, the sidewall of the through hole is formed with two notches on opposite sides, the second resilient element is disposed on bottom of the activation sleeve for increasing an upward force of the sliding sleeve.

14. The lock structure of claim 12, wherein the rotatable slider has a recess for use with a positioning block to position the rotatable slider.

15. The lock structure of claim 1, wherein the activation device includes a key lock, selectively being in a locked configuration and an unlocked configuration, the key lock has a lock core, a lock core sleeve, and an assembly member, the lock core is disposed inside the lock core sleeve and connects with the assembly member.

16. The lock structure of claim 15, wherein the lock core sleeve has two notches on opposite sides for engaging with a plurality of lock tongues of the lock core; when the key lock is in the unlocked configuration, the plurality of the lock tongues are released from the notches to allow the assembly member to rotate; when the key lock is in the locked configuration, the lock tongues engage with the notches to prevent the assembly member from rotating.

17. The lock structure of claim 1, further comprising:

a positioning device for positioning the combination lock and the setting device;

a housing for accommodating the positioning device and the activation device, wherein the activation device is disposed on one side of the positioning device; and a cover for covering the housing, wherein the cover is formed with a plurality of holes corresponding to the dials.

18. The lock structure of claim 1, further comprising a shield rotatably connected to the activation device to selectively be in a locked position and an unlocked position.

* * * * *